US005894800A

United States Patent [19]

Bär et al.

[11] Patent Number: 5,894,800

[45] Date of Patent: Apr. 20, 1999

[54] DEVICE FOR WASHING OUTER CYLINDRICAL SURFACES OF A ROTARY PRINTING PRESS

[75] Inventors: Wolfgang Bär, Gross-Rohrheim; Gerhard Loos, Mannheim, both of Germany

[73] Assignee: Heidelberger Druckmaschinen Aktiengesellschaft, Heidelberg, Germany

[21] Appl. No.: 08/755,467

[22] Filed: Nov. 22, 1996

[30] Foreign Application Priority Data

Nov. 22, 1995 [DE] Germany ..... 195 43 518

[51] Int. Cl.[6] ..... B41F 35/00

[52] U.S. Cl. ..... 101/425; 101/423; 15/256.51

[58] Field of Search ..... 101/425, 424, 101/423, 375; 15/256.3, 256.52, 99, 256.53, 256.51; 399/352

[56] References Cited

U.S. PATENT DOCUMENTS

| | | | |
|---|---|---|---|
| 5,390,602 | 2/1995 | Görl | 101/425 |
| 5,570,634 | 11/1996 | Harter | 101/375 |

FOREIGN PATENT DOCUMENTS

| | | |
|---|---|---|
| 0315154 | 5/1989 | European Pat. Off. . |
| 0520521 | 12/1992 | European Pat. Off. . |
| 0564795 | 10/1993 | European Pat. Off. . |
| 0600361 | 6/1994 | European Pat. Off. . |
| 2636268 | 3/1990 | France . |
| 3909119 | 9/1990 | Germany . |
| 9213605 | 1/1993 | Germany . |
| 4211310 | 10/1993 | Germany . |
| 2013568 | 8/1979 | United Kingdom . |
| WO 87/04665 | 8/1987 | United Kingdom . |
| 2222552 | 3/1990 | United Kingdom . |

*Primary Examiner*—Edgar Burr
*Assistant Examiner*—Dave A. Ghatt
*Attorney, Agent, or Firm*—Nils H. Ljungman and Associates

[57] ABSTRACT

A device for washing outer cylindrical surfaces of a rotary printing machine is disclosed. The device uses a washing cloth which is unwound from a supply roll and, via a pressing-on rail, supplied to a take-up roll. The washing cloth is pressable by the pressing-on rail against the outer cylindrical surface to be washed. To simplify operation only the two washing-cloth rolls with the washing cloth are changed and the other components of the washup device remain inside the machine.

20 Claims, 5 Drawing Sheets

DEVICE FOR WASHING OUTER CYLINDRICAL SURFACES OF A ROTARY PRINTING PRESS

BACKGROUND OF THE INVENTION

1. Field of the Invention

The invention relates generally to a device for washing outer cylindrical surfaces of a rotary printing press, which device has a washing cloth, which washing cloth is unwound from a supply roll and, via a pressing-on rail, supplied to a take-up roll, with the washing cloth being pressable by means of the pressing-on rail against the outer cylindrical surface to be washed.

2. Background Information

German Utility Model 92 13 605 shows a known washup device provided with a washing bar, the washing bar receiving both the supply roll and the take-up roll for the washing cloth as well as a pressing-on rail and other parts designed to wet and control the washup device. By way of clutches and plug connections the washing bar is connected to connecting units and received by a suspension device. With respect to the printing unit the washing bar may be moved, as a unit, out of the suspension device and into the suspension device, respectively. The disadvantage of this known embodiment is that the weight of the washing bar with all its parts is relatively enormous, and that when the device for washing is removed from the printing press the pressman has to carry this weight. Moreover, the washup device is very complicated and requires special measures to be taken in view of the clutch of the washing bar with the clutches different control elements and moving parts.

OBJECT OF THE INVENTION

Proceeding from this state of the art, it is the object of the present invention to provide a device for washing outer cylindrical surfaces causing little technical efforts and ensuring a simple handling when changing washing cloths.

SUMMARY OF THE INVENTION

According to the invention this object is achieved in that the supply roll and the take-up roll with the washing cloth are guided in a bearing and disposed so as to be removable from the machine parallel to the direction of the cylinder axis. The weight of the bearing is relatively small, and the pressman merely has to remove the bearing and the two washing-cloth rolls from the machine so that the parts are easy to handle. Moreover, it is not necessary to remove any supply elements, control elements, or moving parts from the machine, or to connect the elements and/or parts to the washup device, thus also reducing to a great extent the necessary technical efforts.

An advantageous embodiment of the invention is characterized in that the supply roll and the take-up roll are mounted on shafts, one end of which shafts is supported in the machine side frame, in that the washing cloth is wound up on a tube which may be slipped on the shaft, in that one end of each tube is fastened to a bearing part, and in that the bearing part is attached to the other machine side frame, with the supply roll and the take-up roll being inserted. After having loosened the fastening and removed the bearing part, the pressman may remove both rolls from the shafts and insert in the printing machine new fresh winding rolls. Thereafter the pressman only has to secure the bearing so that a new washing cloth is available in a very short time.

In an advantageous embodiment, with the supply roll and the take-up roll being inserted, the pipes may be connected to the shafts via rotary connections so that the insertion brings about a rotary drive for the take-up roll.

A somewhat modified embodiment is characterized in that both ends of the pipes are supported in bearing parts, in that the bearing parts are connected to each other via guiding rails, and in that a bearing part is fastened with one end thereof to a machine side frame, with the supply roll and the take-up roll being slipped on. With this embodiment, which is relatively easy to design, only the two washing-cloth rolls are changed, with the pressing-on rail, for example, remaining in the machine.

In a relatively simple specimen embodiment, the two bearings parts with the supply roll and the take-up roll may be inserted on a rail into the working position of the washup device so as to be parallel to the outer cylindrical surface. A further advantage is the fact that, in its working position, the washup device is secured by means of a locking bolt catching in a recess formed in the rail. In this connection it may be advantageous that, with the washup device being in a working position, the detecting means detecting the cloth supply on the supply roll are in an operational position. These features facilitate the changing of the washing cloth, without the pressman having to carry heavy loads.

One feature of the invention resides broadly in a device for washing an outer surface of a cylinder in a rotary printing press, the cylinder having a longitudinal axis and an axial direction along the longitudinal axis, the device being for unwinding a washing cloth from a supply roll and for winding the washing cloth on a take-up roll, the device being for pulling the washing cloth across a pressing-on rail, which pressing-on rail being for pressing the washing cloth against the outer surface of the cylinder to be washed, the device comprising: bearing arrangement for supporting the supply roll and the take-up roll; the bearing arrangement being disposed to guide at least the supply roll and the take-up roll in a direction substantially parallel to the axial direction, upon removal of the supply roll and the take-up roll.

Another feature of the invention resides broadly in a device for washing an outer surface of a cylinder in a rotary printing press, the cylinder having a longitudinal axis and an axial direction along the longitudinal axis, the device being for unwinding a washing cloth from a supply roll and for winding the washing cloth on a take-up roll, the device being for pulling the washing cloth across a pressing-on rail, which pressing-on rail being for pressing the washing cloth against the outer surface of the cylinder to be washed, the device comprising: a guide; the guide comprising an arrangement for supporting the supply roll; the guide comprising an arrangement for supporting the take-up roll; the guide being disposed to guide at least the supply roll and the take-up roll in a direction substantially parallel to the axial direction, upon removal of the supply roll and the take-up roll.

BRIEF DESCRIPTION OF THE DRAWINGS

A specimen embodiment of the invention is schematically illustrated in the drawings.

DESCRIPTION OF THE PREFERRED EMBODIMENT

Figure 1:
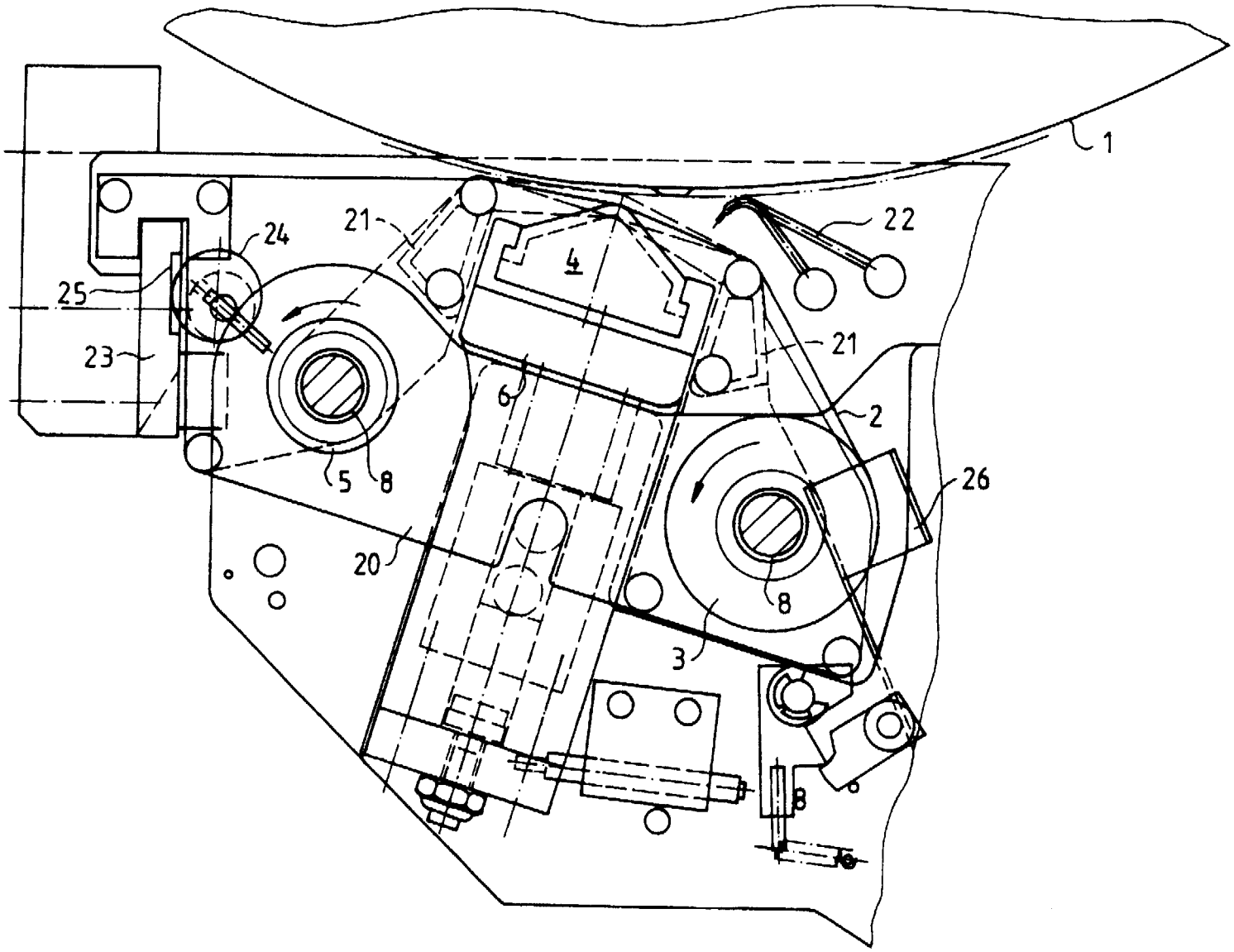
FIG. 1 is a side elevational view of a washup device.

The device for washing an outer cylindrical surface 1 shown in FIG. 1 may, for example, be assigned to a blanket cylinder or an impression cylinder of a rotary printing press (the cylindrical surface 1 may be a blanket cylinder, an impression cylinder, or possibly another type of cylinder). In this case, a washing cloth 2 is unwound from a supply roll 3 and supplied to a take-up roll 5 via a pressing-on rail 4. The pressing-on rail 4 may be provided in a fixture 6 and be pressed against the outer cylindrical surface 1 via control means.

Figure 2:
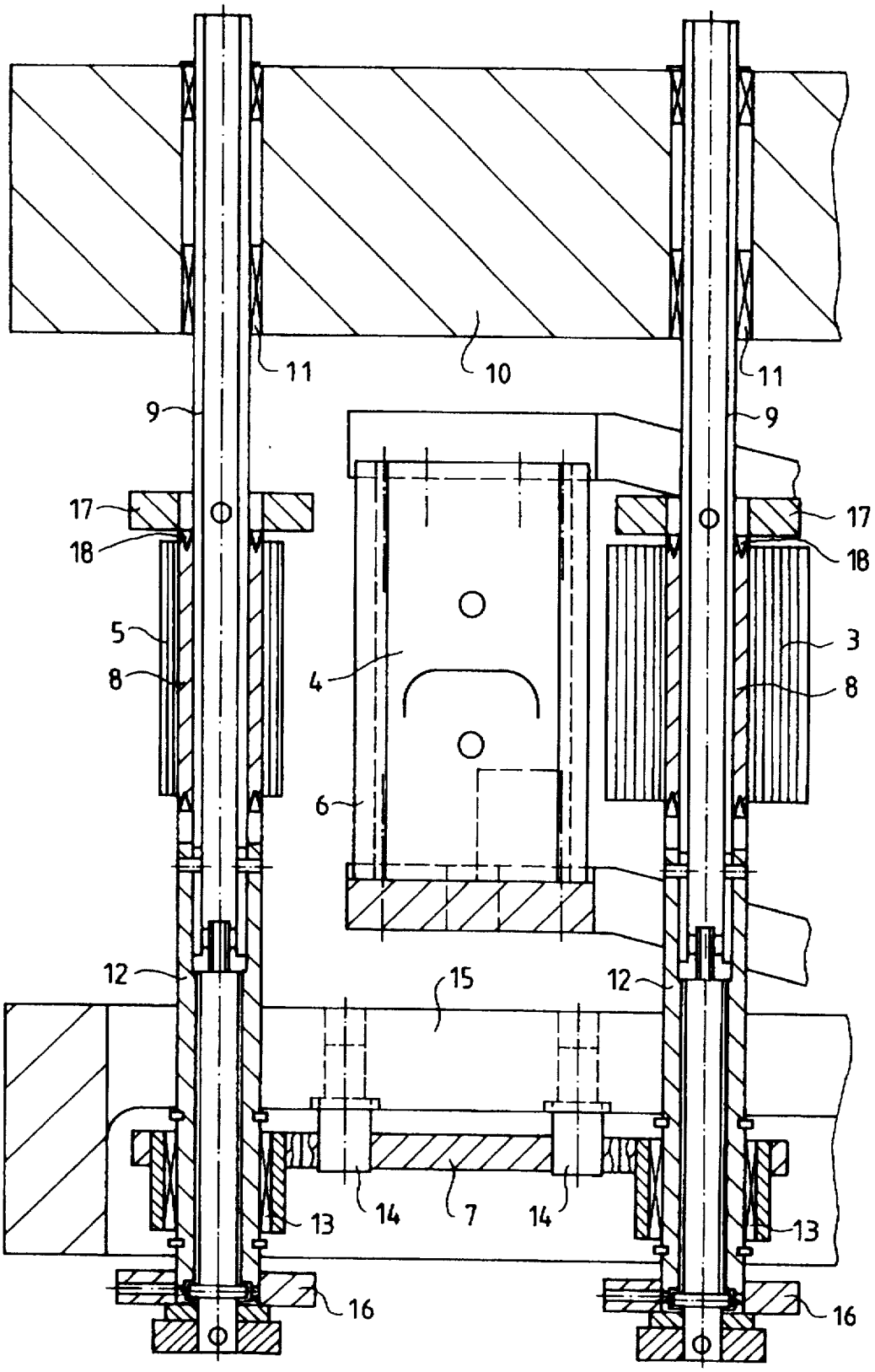
FIG. 2 is a sectional view of the washup device, seen in longitudinal direction.

Referring to FIG. 2, when exchanging a used washing cloth 2 for a new washing cloth 2, for example, the supply roll 3 and the take-up roll 5 may be removed from the machine by means of a bearing 7. In the specimen embodiment shown, the washing cloth 2, on each of the supply roll 3 and the take-up roll 5, is wound up on a pipe or tube 8, with each tube 8 being slippable onto a shaft 9 supported in a machine side frame 10 via ball bearings 11. A rotary drive may be provided on one of the shafts 9 for the purpose of continuing to turn the washing cloth 2 by a certain amount so that a clean washing-cloth section is available for the washing of the outer cylindrical surface 1.

On the opposite side the tubes 8 are fastened to hollow shafts 12. The hollow shafts 12 are supported in bearing 7 via ball bearings 13. The bearing 7 may, in turn, be slipped on guiding bolts 14 secured in the printing press side frame 15. Via handwheels 16 fastened to hollow shafts 12, the supply roll 3 and the take-up roll 5 may be turned by hand. Disks 17 may be provided on the shaft 9, which disks 17 producing, via needles, tapered pins, or pointed pins 18, a rotary connection with respect to the corresponding tube 8 and thus with respect to the supply roll 3 and the take-up roll 5, respectively. By turning the shaft 9, it is ensured that the take-up roll 5 is turned as well. That is, if shaft 9 is turned the respective roll, take-up roll 5 or supply roll 3, is also turned by way of needles 18.

Side frame 10 is on the opposite side of the printing press from side frame 15.

According to the embodiment of the present invention disclosed in FIG. 2, one possible method of exchanging a washing cloth 2, along with the take-up roll 5 and supply roll 3, is to disengage the bearing 7 from the printing press side frame. The entire unit associated with the bearing 7 can then be removed from the ends of the shafts 9. The unit associated with the bearing 7 includes ball bearings 13, handwheels 16, hollow shafts 12, and needles 18 disposed on hollow shafts 12. Thus, the hollow shafts 12 are removed from the shafts 9, so that the tubes 8 can be slid off and on from the shafts 9. The operator can then easily replace a washing cloth 2.

Figure 3:
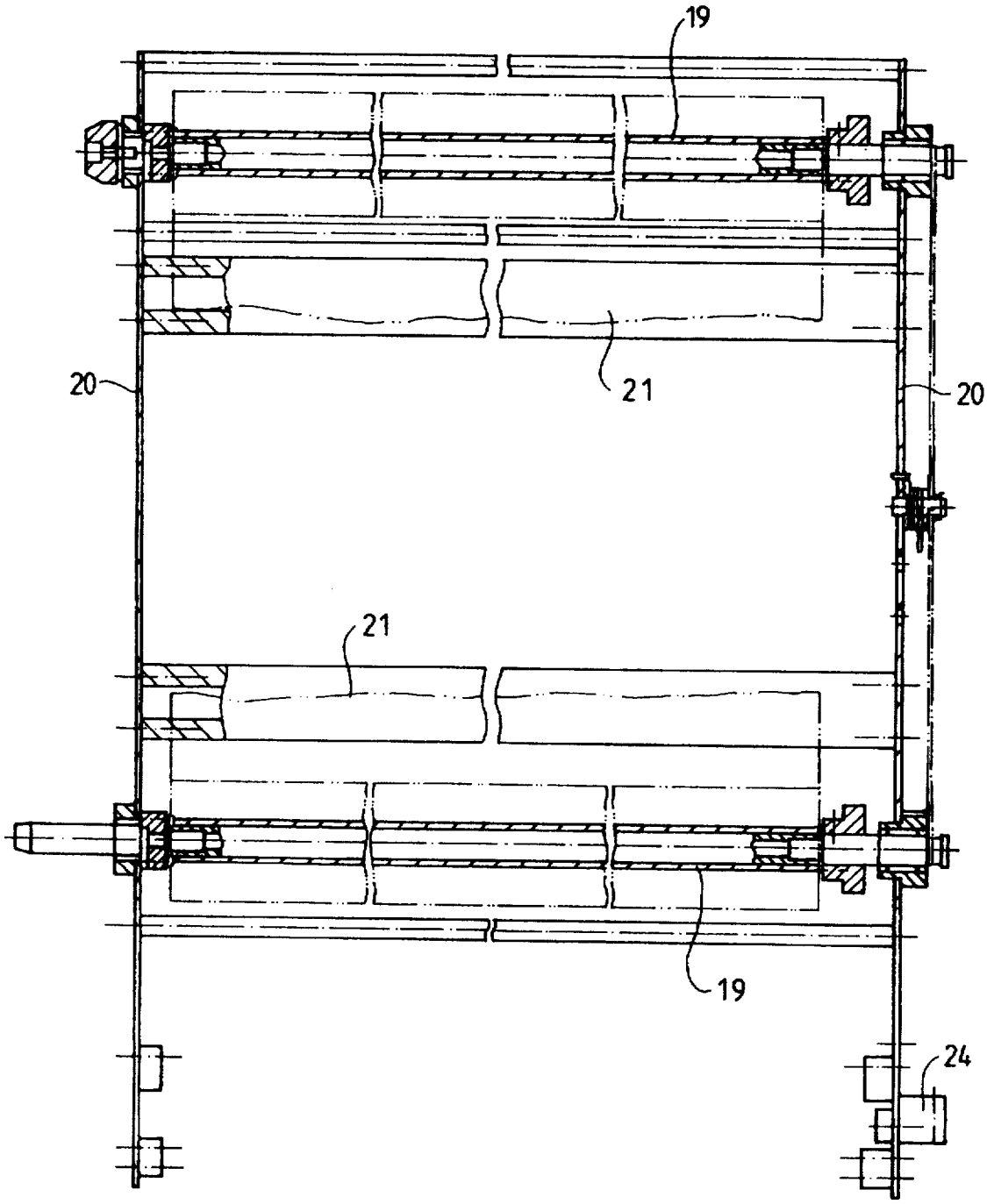
FIG. 3 is a top sectional view of an embodiment of a washup device.

The embodiment according to FIG. 3 differs from that in FIG. 2 in that both ends of the pipes 19 are mounted in bearing parts 20. Said bearing parts 20 are connected to each other via guiding rails 21 extending over the width of the washing cloth 2. As is shown in FIG. 1, the washing cloth 2 is guided on the guiding rails 21 and, before the pressing-on rail 4, wetted with washup fluid by means of dripping pipes 22. One end of the bearing parts 20 may be fastened to a printing press side frame 10 or 15. On a rail 23 both bearing parts 20 may be inserted into the working position of the washup device so as to be parallel to the outer cylindrical surface 1. By means of a locking bolt 24 the washup device may be secured in its working position, with the locking bolt 24 catching in a recess 25 formed in the rail 23. Furthermore, with the washup device being in a working position, the cloth supply on the supply roll 3 is controlled or monitored by means of detecting means 26 which are moved into an operational position, when inserting the supply roll.

Devices for detecting or monitoring the remaining amount of a supply on a roll are well known and are therefore not discussed any further.

Figure 3A:
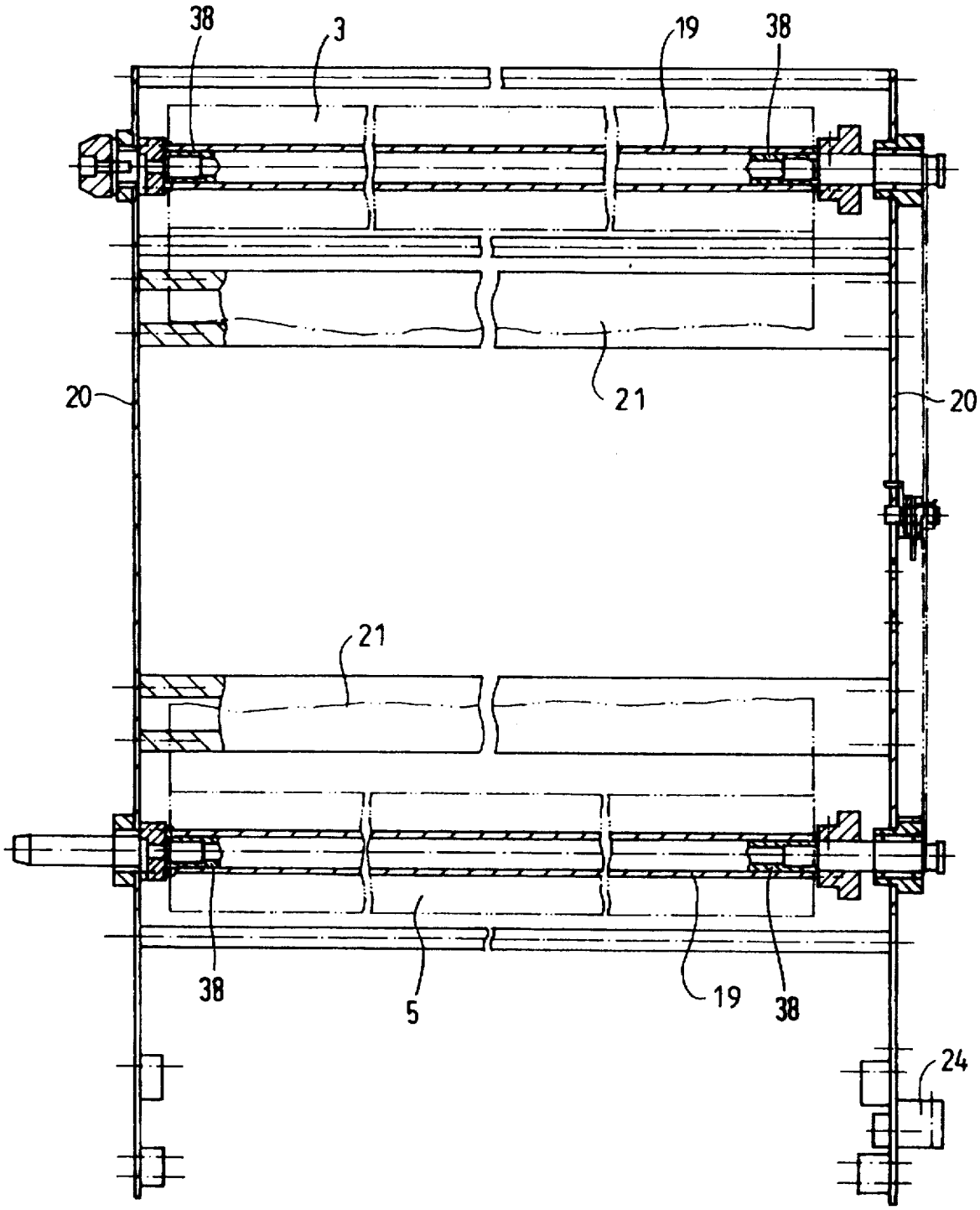
FIG. 3A is a top sectional view of an embodiment of a washup device.

FIG. 3A shows the embodiment of FIG. 3 but with more details of the structure. The embodiment according to FIG. 3A differs from that in FIG. 2 in that the rolls 3, 5 are mounted on tubes or pipes 19 rather than tubes 8. In addition, each of the tubes 19 are slid on to shafts 38 (shown in partial section), which shafts 38 take the place of shafts 9. Both ends of the shafts 38 are mounted in bearing parts 20. The bearing parts 20 are connected to each other via guiding rails 21 extending over the width of the washing cloth 2. One end of the bearing parts 20 may be fastened to a printing press side frame 10 or 15, as discussed above.

Thus, using the embodiment of FIG. 3, one possible method of exchanging a washing cloth 2, along with the take-up roll 5 and supply roll 3, is to disengage the bearings 20 from the printing press side frame 10 or 15. The entire unit associated with the bearings 20 can then be removed from the printing press side frame 10 or 15. The unit associated with the bearings 20 includes tubes 19, guiding rails 21, and the other structures shown in FIG. 3. The bearings 20 can be disconnected and removed from the rail 23, which rail 23 is mounted on the printing press side frame 10 or 15. The entire unit can be slid along the rail 23 in a direction parallel to the longitudinal axis of a cylinder having the cylindrical surface 1, to remove the unit from the printing press. Thus, once the unit associated with bearings 20 is removed, the operator can then replace the washing cloth 2.

Thus, using the embodiment of FIG. 3A, one possible method of exchanging a washing cloth 2, along with the take-up roll 5 and supply roll 3, is to disengage the bearings 20 from the printing press side frame 10 or 15. The entire unit associated with the bearings 20 can then be removed from the printing press side frame 10 or 15. The unit associated with the bearings 20 includes tubes 19, guiding rails 21, shafts 38, and the other structures shown in FIG. 3. The bearings 20 can be disconnected and removed from the rail 23, which rail 23 is mounted on one or both of the printing press side frames 10, 15. The entire unit can be slid along the rail 23 in a direction parallel to the longitudinal axis of a cylinder having the cylindrical surface 1, to remove the unit from the printing press. Thus, once the unit associated with bearings 20 is removed, the operator can then replace the washing cloth 2. To replace the washing cloth 2, the operator can first remove shafts 38 from the bearings 20. Next the tubes 19 of the used washing cloth 2 can be slid off the shafts 38. The tubes 19 of a new washing cloth 2 can then be slid over the shafts 38, and the shafts 38 can then be replaced in the bearings 20.

Figure 4:
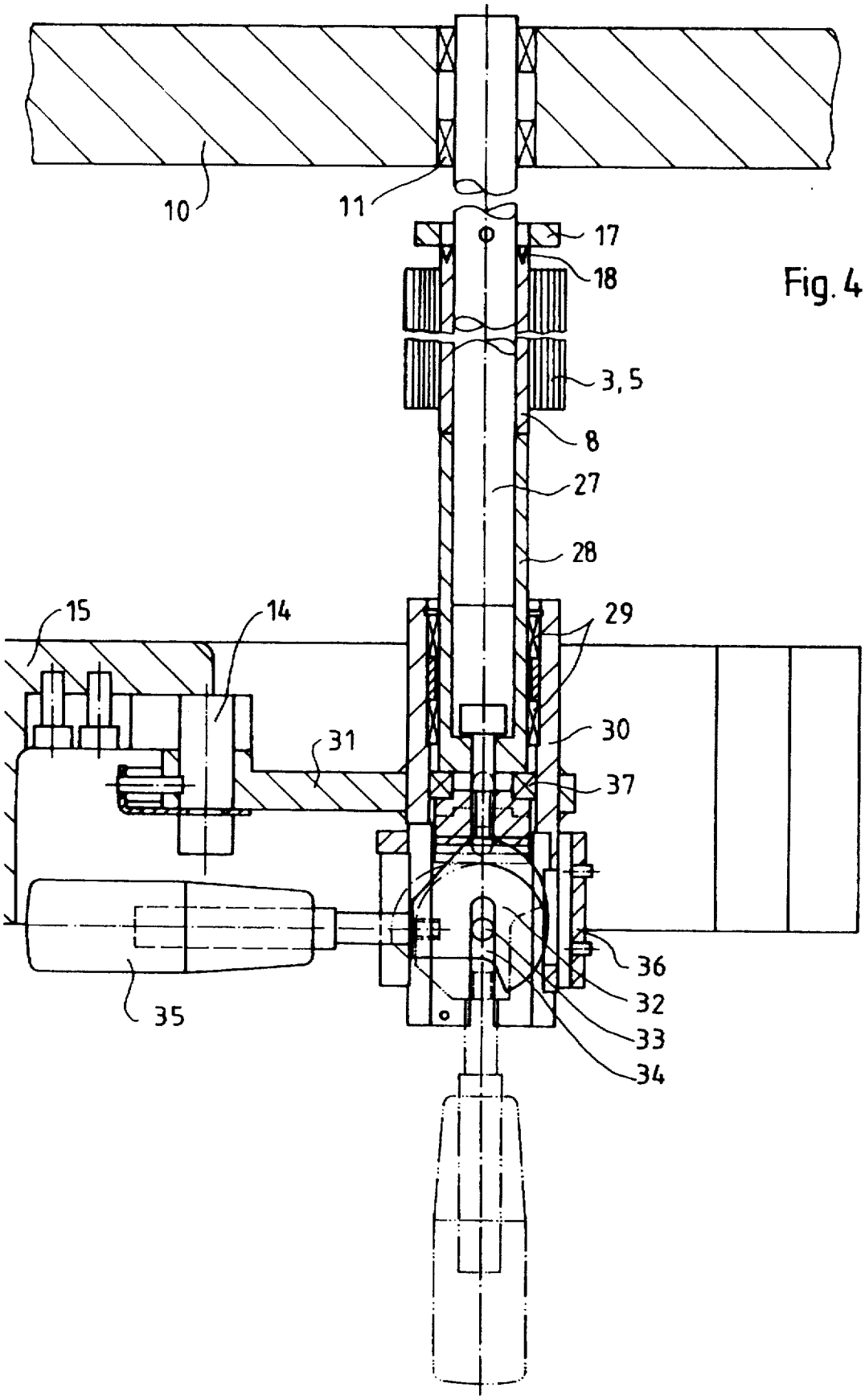
FIG. 4 is a sectional view, seen in longitudinal direction, illustrating how the rolls are mounted in a modified embodiment.

FIG. 4 shows a somewhat modified embodiment of the device disclosed in FIG. 2. In this case, too, a cantilevered shaft 27 on which the supply roll 3 and the take-up roll 5 with the tubes 8 are slipped is supported in the printing press side frame 10 via ball bearings 11. After having changed supply roll 3 or take-up roll 5, a thrust piece 28 is slipped on the cantilevered shaft 27, which thrust piece 28, via ball bearings 29, is supported in a sleeve 30. It is also conceivable to fasten the sleeve 30 to the printing press side frame 15, via a bearing 31 and a guiding bolt 14, for each roll 3, 5 separately. As, according to this embodiment, both washing-cloth rolls 3, 5 are changed in the machine, the bearing 31 with the sleeve 30 and the thrust piece 28 is slipped on the cantilevered shaft 27 after each changing process.

Two clamping eccentrics 32 which, via pins 33, may be inserted in a slit 34 provide a quick-action clamping device which, by actuating a handle 35, may clamp the pipe 8 of the supply roll 3 and the take-up roll 5, respectively. FIG. 4 shows the handle 35 in a clamped condition as a solid line and in an unclamped condition as a dash-dot line. Thus, the pressman moves the double clamping eccentric 32 into the slit 34 to such a degree that the thrust piece 28 abuts against the pipe 8. By pivoting the handle 35 into the position indicated by a solid line an outer sleeve 36 and the sleeve 30 are clamped together via a clamping eccentric 32, and thereafter the second clamping eccentric 32 moves the thrust piece 28 on the cantilevered shaft 27, via a thrust bearing 37, until the pipe 8 is secured so as to be fixed against rotation in the needles 18 of the disk 17 fastened to the cantilevered shaft 27.

In other words, the clamping action of the clamping eccentrics 32 can be described as follows. To assemble the parts before clamping, a roll 3 or 5, with the tube 8, is slid over the corresponding cantilevered shaft 27. Next the thrust piece 28 is slid onto the cantilevered shaft 27 and thrust piece 28. Then the sleeve 30 containing the thrust bearing 37, along with the attached bearing 31, is slid onto the cantilevered shaft 27. The bearing 31 can then be attached to the printing press side frame 15 by way of the guiding bolt 14. The outer sleeve 36 can then be placed on the sleeve 30. Next the pins 33 of the clamping eccentric 32 are slid into the slit or slot 34 (shown by the dash-dot line representation of clamping eccentric 32 and handle 35). The distance into the slit 34 that the pins 33 are inserted can be adjusted by the operator, so that the tube 8 is held with the appropriate tightness. The operator then moves the handle 35 of the clamping eccentric 32 to the clamping position (shown by the solid line representation of clamping eccentric 32 and handle 35). The double clamping eccentric 32 has two eccentrics which two eccentrics each perform a separate clamping function. When the double clamping eccentric 32 is in the clamped position (solid lines) a first eccentric, seen to the right adjacent the wall of the sleeve 30, clamps the sleeve 30 and the outer sleeve 36 together, so that the outer sleeve 36 will not slide on the sleeve 30. The pins 33 engaging the slit 34, provide a fulcrum on which the double clamping eccentric 32 can pivot, thereby both clamping the sleeve 30 and the outer sleeve 36 together and, at the same time, forcing the pins 33 against the side of the slit 34, thus preventing the pins 33 from sliding in the slit 34. In addition, when the double clamping eccentric 32 is in the clamped position (solid lines) a second eccentric, seen towards the top of the double clamping eccentric 32 in the center of the sleeve 30, pushes thrust piece 28 along the cantilevered shaft 27 by way of thrust bearing 37. Thus, upon clamping the double clamping eccentric 32 clamps the sleeve 30 and the outer sleeve 36 together and clamps the tube 8 between the thrust piece 28 and the needles 18. The slit 34 can be a portion of the outer sleeve 36, thus forcing the outer sleeve 36 against the sleeve 30 upon clamping. However, it is also possible to locate the slit 34 in the sleeve 30.

One feature of the invention resides broadly in the device for washing outer cylindrical surfaces in a rotary printing machine, said device comprising a washing cloth being unwound from a supply roll and being supplied to a take-up roll via a pressing-on rail, with said washing cloth being pressable by means of said pressing-on rail against the outer cylindrical surface to be washed, characterized in that said supply roll 3 and said take-up roll 5 with said washing cloth 2 are guided in a bearing 7 and disposed as as to be removable from the machine parallel to the direction of the cylinder axis.

Another feature of the invention resides broadly in the device characterized in that said supply roll 3 and said take-up roll 5 are mounted on shafts 9 one end of each of which is supported in a machine side frame 10, that said washing cloth is wound up on a pipe 8 which may be slipped on said shaft 9, that one end of a respective pipe 8 is secured in a respective hollow shaft 12, and that said hollow shafts 12 with bearing 7 are fastened to the other machine side frame 15, with said supply roll 3 and said take-up roll 5 being slid in.

Yet another feature of the invention resides broadly in the device characterized in that, with said supply roll 3 and said take-up roll 5 being in a slid-in condition, said pipes 8 may be connected to said shafts 9 via rotary connections.

Still another feature of the invention resides broadly in the device characterized in that pipes 19 are supported, with both ends thereof, in bearing parts 20, that said bearing parts 20 are connected to each other via guiding rails 21, and that, with said supply roll 3 and said take-up roll 5 being slipped on, one end of a respective bearing part 20 is fastened to the machine side frame via pins.

A further feature of the invention resides broadly in the device characterized in that on a rail 23 both bearing parts 20 with said supply roll 3 and said take-up roll 5 may be moved into a working position of the washup device so as to be parallel to the outer cylindrical surface 1.

Another feature of the invention resides broadly in the device characterized in that, when being in a working position, said washup device is secured by means of a locking bolt 24 catching in a recess 25 formed in said rail 23.

Yet another feature of the invention resides broadly in the device characterized in that, with the washup device being in a working position, detecting means 26 detecting the washing-cloth supply on said supply roll 3 are moved into an operational position.

Still another feature of the invention resides broadly in the device characterized in that said supply roll 3 and said take-up roll 5 are slipped on cantilevered shafts 27 one end of which is pivot-mounted in the machine side frame, and that, on the opposite side, clamping eccentrics 32 are provided, said clamping eccentrics connecting said supply roll 3 and said take-up roll 5 to said cantilevered shafts 27 so as to be fixed against rotation.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein, are hereby incorporated by reference as if set forth in their entirety herein.

The corresponding foreign patent publication applications, namely, Federal Republic of Germany Patent Application No. 195 43 518.4, filed on Nov. 22, 1995, having inventors Wolfgang Bär and Gerhard Loos, and DE-OS 195 43 518.4 and DE-PS 195 43 518.4, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 outer cylindrical surface
2 washing cloth
3 supply roll
4 pressing-on rail
5 take-up roll
6 fixture
7 bearing
8 pipe
9 shaft
10 machine side frame
11 ball bearing
12 hollow shaft
13 ball bearing
14 guiding bolt
15 machine side frame
16 handwheel
17 disk
18 needle
19 pipe
20 bearing part
21 guiding rail
22 dripping pipe
23 rail
24 locking bolt
25 recess
26 detecting means
27 cantilevered shaft
28 thrust piece
29 ball bearing
30 sleeve
31 bearing
32 clamping eccentric
33 pin
34 slit
35 handle
36 sleeve
37 thrust bearing

What is claimed is:

1. A device for washing an outer surface of a cylinder in a rotary printing press, the cylinder having a longitudinal axis and an axial direction along the longitudinal axis, said device comprising:

a device to press a washing cloth against an outer surface of a cylinder;

a device to direct a washing cloth across said device to press a washing cloth against an outer surface of a cylinder;

a device to support a supply roll to supply a washing cloth and a take-up roll to take up a washing cloth;

said device to support a supply roll and a take-up roll comprising a device to unwind a washing cloth from a supply roll and to wind a washing cloth onto a take-up roll;

said device to support a supply roll and a take-up roll comprising a device to permit removal of a supply roll and a take-up roll with a washing cloth in a direction substantially parallel to the axial direction of the cylinder;

said device to permit removal of a supply roll and a take-up roll comprising a first supporting portion and a second supporting portion;

said first supporting portion comprising an axial dimension and a transverse dimension transverse to the axial dimension;

said axial dimension of said first supporting portion comprising an axis;

said axis being disposed along said axial dimension of said first supporting portion;

said first supporting portion being dimensioned to support a tube of a supply roll of a washing cloth which tube has a length dimension and a diametral dimension;

said transverse dimension of said first supporting portion being dimensioned to support the diametral dimension of a tube of a supply roll of a washing cloth;

said axial dimension of said first supporting portion being dimensioned to support the length dimension of a tube of a supply roll of a washing cloth; and said axis of said first supporting portion being substantially parallel to the axial direction of the cylinder.

2. The device for washing an outer surface of a cylinder in a rotary printing press according to claim 1, wherein:

said first supporting portion comprises a first shaft;

said first shaft is configured and disposed for supporting a supply roll;

said device to permit removal of a supply roll and a take-up roll comprises a device to support said first shaft on a first side frame of a printing press;

said second supporting portion comprises a second shaft;

said second shaft is configured and disposed for supporting a take-up roll;

said device to permit removal of a supply roll and a take-up roll comprises a device to support said second shaft on a first side frame of a printing press;

said first shaft is configured to permit a supply roll of a washing cloth disposed on a tube to be slid onto said first shaft;

said second shaft is configured to permit a take-up roll of a washing cloth disposed on a tube to be slid onto said second shaft;

said device to permit removal of a supply roll and a take-up roll comprises apparatus to secure a tube of a washing cloth supply roll to said first shaft and to secure a tube of a washing cloth take-up roll to said second shaft;

said apparatus to secure a tube comprises apparatus to support said first shaft and said second shaft on a second side frame of a printing press;

said apparatus to support said shafts on a second side frame comprises a first hollow shaft;

said first hollow shaft is configured to secure a tube of a washing cloth supply roll to said first shaft;

said apparatus to support said shafts on a second side frame comprises a second hollow shaft;

said second hollow shaft is configured to secure a tube of a washing cloth take-up roll to said second shaft; and said apparatus to support said shafts on a second side frame is configured to be removable from said first shaft and said second shaft to permit installation and removal of a washing cloth on said first shaft and said second shaft.

3. The device for washing an outer surface of a cylinder in a rotary printing press according to claim 2, wherein:

said apparatus to secure a tube comprises a device to rotate a tube of a washing cloth supply roll together with said first shaft; and said apparatus to secure a tube comprises a device to rotate a tube of a washing cloth take-up roll together with said second shaft.

4. The device for washing an outer surface of a cylinder in a rotary printing press according to claim 3, wherein:

said device to rotate a tube of a washing cloth supply roll together with said first shaft comprises a hand wheel disposed on said first hollow shaft to permit manual rotation of a washing cloth supply roll disposed on said first shaft; and said device to rotate a tube of a washing cloth take-up roll together with said second shaft comprises a hand wheel disposed on said second hollow shaft to permit manual rotation of a washing cloth take-up roll disposed on said second shaft.

5. The device for washing an outer surface of a cylinder in a rotary printing press according to claim 4, wherein:

said first hollow shaft comprises at least one pointed pin;

said at least one pointed pin of said first hollow shaft is configured to non-rotationally connect a washing cloth supply roll to said first hollow shaft;

said second hollow shaft comprises at least one pointed pin; and said at least one pointed pin of said second hollow shaft is configured to non-rotationally connect a washing cloth take-up roll to said second hollow shaft.

6. The device for washing an outer surface of a cylinder in a rotary printing press according to claim 5, wherein:

said first shaft comprises at least one pointed pin;

said at least one pointed pin of said first shaft is configured to non-rotionally connect a washing cloth supply roll to said first shaft;

said second shaft comprises at least one pointed pin; and said at least one pointed pin of said second shaft is configured to non-rotionally connect a washing cloth take-up roll to said second shaft.

7. The device for washing an outer surface of a cylinder in a rotary printing press according to claim 6, wherein:

said apparatus to support said first and second shafts on a second side frame of a printing press comprises a bearing part;

said bearing part comprises at least one guide bolt for connecting to a second side frame of a printing press;

said first hollow shaft is disposed on said bearing part to rotate with respect to said bearing part; and said second hollow shaft is disposed on said bearing part to rotate with respect to said bearing part.

8. The device for washing an outer surface of a cylinder in a rotary printing press according to claim 1, wherein:

said first supporting portion comprises a first bearing part;

said second supporting portion comprises a second bearing part;

said first bearing part and said second bearing part are disposed to support a supply roll of a washing cloth disposed on a tube;

said first bearing part and said second bearing part are disposed to support a take-up roll of a washing cloth disposed on a tube;

said device to direct a washing cloth comprises at least one guiding rail;

said at least one guiding rail is configured to direct a washing cloth across said device to press a washing cloth against an outer surface of a cylinder;

said at least one guiding rail is disposed to connect said first bearing part to said second bearing part; and at least one of said first bearing part and said second bearing part is connected to a side frame of a printing press.

9. The device for washing an outer surface of a cylinder in a rotary printing press according to claim 8, wherein:

said device comprises a rail connected to a side frame of a printing press;

said first bearing part and said second bearing part being moveable on said rail into a working position for washing an outer surface of a cylinder; and said first bearing part and said second bearing part position a rotational axis of a washing cloth supply roll and a rotational axis of a washing cloth take-up roll substantially parallel to the longitudinal axis of a cylinder to be washed, upon said first bearing part and said second bearing part being moved into the working position.

10. The device for washing an outer surface of a cylinder in a rotary printing press according to claim 9, wherein:

at least one of said first bearing part and said second bearing part comprises an apparatus to secure said at least one of said first bearing part and said second bearing part to said rail upon the device for washing being in the working position;

said apparatus to secure said at least one of said first bearing part and said second bearing part to said rail comprises a locking bolt; and said locking bolt is disposed to catch in a recess of said rail.

11. The device for washing an outer surface of a cylinder in a rotary printing press according to claim 9, wherein said device for washing comprises an apparatus to move a device for detecting a washing cloth supply on a supply roll into a position for detecting a washing cloth supply on a supply roll upon said device for washing being in the working position.

12. The device for washing an outer surface of a cylinder in a rotary printing press according to claim 1, wherein:

said device to permit removal of a supply roll and a take-up roll comprises a first shaft;

said first shaft is cantilever mounted on a side frame of a printing press;

said first shaft is configured and disposed for supporting a supply roll;

said device to permit removal of a supply roll and a take-up roll comprises a second shaft;

said second shaft is cantilever mounted on a side frame of a printing press;

said second shaft is configured and disposed for supporting a take-up roll;

said first shaft is configured to permit a supply roll of a washing cloth disposed on a tube to be slid onto said first shaft;

said second shaft is configured to permit a take-up roll of a washing cloth disposed on a tube to be slid onto said second shaft;

said device to permit removal of a supply roll and a take-up roll comprises a device to non-rotationally secure a tube of a washing cloth supply roll to said first shaft and to non-rotationally secure a tube of a washing cloth take-up roll to said second shaft, to permit a supply roll to rotate with said first shaft and to permit a take-up roll to rotate with said second shaft;

said tube securing device comprises a device to support said first shaft on a side frame of a printing press opposite to a side frame on which said first shaft is cantilever mounted;

said tube securing device comprises a device to support said second shaft on a side frame of a printing press opposite to a side frame on which said second shaft is cantilever mounted;

said device to support said first shaft comprises a first clamping eccentric; and said device to support said second shaft comprises a second clamping eccentric.

13. The device for washing an outer surface of a cylinder in a rotary printing press according to claim 12, wherein said first clamping eccentric is moveable between a position for clamping a supply roll to said first shaft and a position for releasing a supply roll from said first shaft.

14. The device for washing an outer surface of a cylinder in a rotary printing press according to claim 13, wherein:

said device to support said first shaft comprises a bearing part;

said bearing part comprises a slit configured to contact said first clamping eccentric; and said first clamping eccentric comprises a pin configured to move within said slit in the releasing position and configured to be fixed within said slit in the clamping position.

15. The device for washing an outer surface of a cylinder in a rotary printing press according to claim 14, wherein:

said bearing part comprises a sleeve for being disposed around said first shaft; and said sleeve comprises said slit.

16. The device for washing an outer surface of a cylinder in a rotary printing press according to claim 15, wherein:

said sleeve comprises a tubular thrust piece configured to fit over said first shaft; and said sleeve comprises a thrust bearing configured to push said tubular thrust piece into contact with a supply roll upon said clamping eccentric being placed in the clamping position.

17. The device for washing an outer surface of a cylinder in a rotary printing press according to claim 16, wherein:

said first shaft comprises at least one pointed pin;

said at least one pointed pin of said first shaft is configured to non-rotationally connect a washing cloth supply roll to said first shaft upon said clamping eccentric being placed in the clamping position;

said bearing part comprises an outer sleeve; and said outer sleeve is configured to be held fixed to said sleeve upon said clamping eccentric being placed in a clamping position.

18. The device for washing an outer surface of a cylinder in a rotary printing press according to claim 17, wherein:

said bearing part comprises at least one guide bolt for connecting to a side frame of a printing press;

said second clamping eccentric is configured to move between a position for clamping a take-up roll to said second shaft and a position for releasing a take-up roll from said second shaft;

said bearing part is a first bearing part;

said device to support said second shaft comprises a second bearing part;

said slit is a first slit;

said second bearing part comprises a second slit configured to contact said second clamping eccentric; and said second clamping eccentric comprises a pin configured to move within said second slit in the second shaft releasing position and configured to be fixed within said slit in the second shaft clamping position.

19. A device for washing an outer surface of a cylinder in a rotary printing press, the cylinder having a longitudinal axis and an axial direction along the longitudinal axis, said device comprising:

apparatus to press a washing cloth against an outer surface of a cylinder;

apparatus to direct a washing cloth across said apparatus to press a washing cloth against an outer surface of a cylinder;

apparatus to support a washing cloth on a supply roll and on a take-up roll;

said apparatus to support a supply roll and a take-up roll comprising apparatus to unwind a washing cloth from a supply roll and to wind a washing cloth onto a take-up roll;

said apparatus to support a supply roll and a take-up roll comprising apparatus to permit removal of a supply roll and a take-up roll with a washing cloth in a direction substantially parallel to the axial direction of the cylinder;

said apparatus to permit removal of a supply roll and a take-up roll comprising a first supporting portion and a second supporting portion;

said second supporting portion comprising an axial dimension and a transverse dimension transverse to the axial dimension;

said axial dimension of said second supporting portion comprising an axis;

said axis being disposed along said axial dimension of said second supporting portion;

said second supporting portion being dimensioned to support a tube of a take-up roll of a washing cloth which tube has a length dimension and a diametral dimension;

said transverse dimension of said second supporting portion being dimensioned to support the diametral dimension of a tube of a take-up roll of a washing cloth;

said axial dimension of said second supporting portion being dimensioned to support the length dimension of a tube of a take-up roll of a washing cloth; and said axis of said second supporting portion being substantially parallel to the axial direction of the cylinder.

20. The device for washing an outer surface of a cylinder in a rotary printing press according to claim 19, wherein:

said first supporting portion comprising an axial dimension and a transverse dimension transverse to the axial dimension;

said axial dimension of said first supporting portion comprising an axis;

said axis being disposed along said axial dimension of said first supporting portion;

said first supporting portion being dimensioned to support a tube of a supply roll of a washing cloth which tube has a length dimension and a diametral dimension;

said transverse dimension of said first supporting portion being dimensioned to support the diametral dimension of a tube of a supply roll of a washing cloth;

said axial dimension of said first supporting portion being dimensioned to support the length dimension of a tube of a supply roll of a washing cloth; and said axis of said first supporting portion being substantially parallel to the axial direction of the cylinder.

* * * * *

UNITED STATES PATENT AND TRADEMARK OFFICE

CERTIFICATE OF CORRECTION

PATENT NO. : 5,894,800

DATED : April 20, 1999

INVENTOR(S) : Wolfgang BÄR and Gerhard LOOS

It is certified that error appears in the above-indentified patent and that said Letters Patent is hereby corrected as shown below:

On the title page, item [56], under the U.S. PATENT DOCUMENTS section, insert the following:

| | | |
|---|---|---|
| --5,519,914 | 05-28-96 | Ronald Egan |
| 5,509,353 | 04-23-96 | Hiroshi Aoki |
| 5,429,048 | 07-04-95 | Gaffney et al. |
| 5,150,650 | 09-29-92 | Yoschichika Murakami |
| 4,757,763 | 07-19-88 | MacPhee et al. |
| 4,344,361 | 08-17-82 | MacPhee et al. |
| 4,033,262 | 07-05-77 | Johne et al.--. |

Signed and Sealed this

Eighth Day of February, 2000

*Attest:*

*Attesting Officer*

Q. TODD DICKINSON

*Commissioner of Patents and Trademarks*